US007698846B2

(12) United States Patent
Do Amarante et al.

(10) Patent No.: US 7,698,846 B2
(45) Date of Patent: Apr. 20, 2010

(54) OWNER RECOGNITION BY PORTABLE GUNS

(76) Inventors: José Carlos Albano Do Amarante, Rua Senador Arthur Bernardes, Filho, 329, Barra da Tijuca, 22793-160 Rio de Janeiro, RJ (BR); Roque Marcelo Versolato, Av. Divino Salvador, 500 apto., 141, Moema, 04078-110 São Paulo, SP (BR); Luis Cristovão de Moraes Sobrino Porto, Rua Panheiro Guimaràes, 149 casa 116, Botafoga, 22281-080 Rio de Janeiro, RJ (BR)

( * ) Notice: Subject to any disclaimer, the term of this patent is extended or adjusted under 35 U.S.C. 154(b) by 0 days.

(21) Appl. No.: 10/593,835

(22) PCT Filed: Sep. 2, 2004

(86) PCT No.: PCT/BR2004/000163

§ 371 (c)(1),
(2), (4) Date: Sep. 22, 2006

(87) PCT Pub. No.: WO2006/024116

PCT Pub. Date: Mar. 9, 2006

(65) Prior Publication Data

US 2007/0209267 A1 Sep. 13, 2007

(51) Int. Cl.
*F41A 17/06* (2006.01)

(52) U.S. Cl. ..... 42/70.06; 42/70.01; 42/70.11

(58) Field of Classification Search ..... 42/70.01, 42/70.11

See application file for complete search history.

(56) References Cited

U.S. PATENT DOCUMENTS 4,970,819 A * 11/1990 Mayhak ..... 42/70.01
5,913,669 A * 6/1999 Hansen et al. ..... 42/146
6,363,223 B1 * 3/2002 Gordon ..... 396/263
6,481,140 B1 * 11/2002 Marshall ..... 42/70.11
6,563,940 B2 * 5/2003 Recce ..... 382/120
6,580,876 B1 * 6/2003 Gordon ..... 396/263
6,735,897 B1 * 5/2004 Schmitter et al. ..... 42/70.01
6,817,130 B2 * 11/2004 Ivanov ..... 42/70.06
7,096,619 B2 * 8/2006 Jackson et al. ..... 42/70.11
7,168,198 B2 * 1/2007 Newkirk et al. ..... 42/70.11

(Continued)

*Primary Examiner*—Troy Chambers
(74) *Attorney, Agent, or Firm*—Bachman & LaPointe, P.C.

(57) ABSTRACT

The invention presented in this work creates the possibility of a portable gun—revolver, pistol, carbine, riffle or hand-machine gun, to recognize its owner, in progressive levels of handling safety. Three levels of handling safety are established based on the evaluation of the grip force or its effect through material deformation or strain gage measurement. The first level of handling safety does not allow persons with grip force bellow a given limit, to shoot with a gun. The second level of handling safety enables the portable gun to recognize an individual as belonging to a smaller group than the first level. Now, the gun will only recognize for a successful firing an individual whose grip force, measured by one strain gage, fit into a small operational range, established and stored at the moment of acquisition by the owner. The third level of handling safety enables a portable gun to recognize an individual, as belonging to an even smaller group than in the second level. In practice this group is unitary and is composed by the person that grasped the handle to establish the average local grip forces, measured by six strain gages, at the acquisition moment.

24 Claims, 10 Drawing Sheets

U.S. PATENT DOCUMENTS

2002/0170220 A1* 11/2002 Recce ..... 42/70.08
2004/0031180 A1* 2/2004 Ivanov ..... 42/70.11
2005/0066567 A1* 3/2005 Newkirk et al. ..... 42/70.11
2007/0074438 A1* 4/2007 Parhofer et al. ..... 42/70.01
2007/0119088 A1* 5/2007 Newkirk et al. ..... 42/70.11
2007/0124979 A1* 6/2007 Newkirk et al. ..... 42/70.11

* cited by examiner

OWNER RECOGNITION BY PORTABLE GUNS

CROSS REFERENCE TO RELATED APPLICATIONS

This case is the U.S. national phase of International Application No. PCT/EP2004/000163 filed Sep. 2, 2004.

BACKGROUND OF THE INVENTION

The Importance of the Hand for Shooting Purposes

When a person shoots a gun, the energy required to pull the trigger is generated entirely by contraction of his muscles. The grasp of the hand on the grip of the gun constitutes the interface between the shooter and the gun.

To maintain control of the gun and transfer energy to the trigger, the hand has to grasp the grip. When the hand grips a handle, it produces a grip force, classically defined as the force applied through the fingers and the palm normal to the handle's surface.

If the grip force is too low, the gun will slip in the hand and the quality of the transfer of energy will be poor. Another possibility is that the system handgun will not be structurally firm and the fire will be erratic. The simple solution to overcome this problem is to increase the grip force. Increasing the grip force ensures that the gun stays firmly in the hand. The literature reveals that the grip force is roughly twice the minimal value required to prevent the hand-held object from slipping.

The Grip Strength Measurement

In jobs that require repetitive gripping, an ergonomic evaluation should include a measure or estimation of the applied grip force.

Grip strength is an important prerequisite to good hand performance. Muscle weakness and impaired motor control are important factors in generating grip force. The impairment is often manifested in decreased ability to perform simple daily tasks such as pouring a drink or feeding.

Within the medical area there are a great number of studies and procedures for testing grip forces. It is a relevant medical subject, since a great number of patients with neurological disturbances present poor manual mobility. Those procedures are of current use in clinical practice to monitor progress during occupational and physical therapy, to assess potential for rehabilitation, or to monitor the likelihood of postoperative complications. To help those patients, equipments based on the grip force are being developed at the same time that researchers look after the characteristics of the patients force to hold an object and to move it. An interesting aspect of medical research is the preoccupation with tennis, measuring the grip force with accuracy, based on the previous knowledge of motion and anticipation of impact.

Both the current equipments and new prototypes vary as the grip force measurement goal is the:

Grip force only;

Neural stimuli related to the grip muscular contraction;

Hand motion;

Average force as a time function.

Another evaluation system, also related to the manual motion, has the objective of determining the grip force and the fine control of objects grabbing between the thumb and the others fingers.

The bibliography shows that the normal grip force used to grab objects varies between 20 and 80 N. The force intensity is related with previous training (for example, using a sensor adapted to a screwdriver employed to fix a screw), previous knowledge of the trajectory of the object to be hit and knowledge of the time of hitting (for example, using a sensor on the handle of a tennis racket).

Grip Force Seen as an Individual "Fingerprint" and Grip Force Threshold for a Specific Task A grip force threshold may be determined for a specific task. This conclusion was demonstrated with a hand dynamometer measuring a screwdriver task, a ratchet task and a lift-and-carry task. Eighteen healthy males (aged between 18-65 years) participated in the study. Data from several lift-and-carry trials were examined and a grip force threshold of 18.6 N was selected to denote the active phase of the lift. For the screwdriver and ratchet tasks, a threshold of 0.56 Newton-meters (Nm) for the applied moment was used to denote the active phase of tool use. Moreover, each and every male had his own grip force signature, as being an individualized fingerprint. Besides, data points with grip force values exceeding the threshold level were included in the trial data. Mean and peak values were calculated for each trial, and the average for the two trials of each condition were calculated. So it was concluded that the mean and peak grip forces were determined for the active phases of all conditions.

SUMMARY OF THE INVENTION

The invention presented in this work deals with the personalization of portable guns—including revolvers, pistols, carbines, riffles and hand machine guns, among others—in progressive levels of sophistication.

First Level of Sophistication

The first level of handling safety, the portable gun will recognize an individual belonging to a group whose grip force is inferior to a specified threshold and will avoid a successful firing by that individual.

Limiting Factor→threshold grip force—first level of handling safety in gun personalization.

Two technical solutions can be devised. Firstly, the coating material of the grasping handle will be produced with a determined resistance that only when an established threshold grip force is surpassed, the trigger unlocking will occur. For instance, a secondary safety pin, always in blocking position, would be released as long as the grip force allows its liberation.

Another form of establishing the threshold grip force as a limiting factor for the employment of a portable gun is through the use of a strain gage, either in the frontal part of the handle in the ergonomic position of the "greater" finger of the hand used to hold the gun, or in the posterior part of the handle in the ergonomic position of the part of hand palm correspondent to the thumb, or even in the right lateral part of the handle, for dextral shooters, or the left lateral part of the handle, for left-handed shooters, in the ergonomic position of the hand palm used to hold the gun.

This type of personalization will be restricted to persons that can employ successfully a gun when their grip force is superior to the established threshold. Persons with grip force bellow the established bottom limit could grab a gun and try to actuate the trigger, but the safety device will not be activated and the action will be unsuccessful.

In this way, the first personalization level of a portable gun will make possible children impediment in shooting guns successfully, in case of having a grip force bellow to the threshold established for activation of the actuation system. Therefore, a portable gun in first level of personalization can employ two types of actuation systems, based on the minimum grip force: material deformation or strain gage.

Second Level of Sophistication

For second level of handling safety, the portable gun will recognize an individual, as belonging to a smaller group than in the first level, whose grip force (F) is within a small range ($Fa-1/2r<F<Fa+1/2r$), where Fa is an average grip force and r is the width of the normal distribution. In reality the gun will recognize his owner because at the moment of acquisition he will hold the handle as many times as it is necessary to compute and store his average grip force and the width of his normal distribution using an electronic circuit, connecting a strain gage to a chip, installed inside the gun handle. After that, the gun will only recognize for a successful firing an individual whose grip force lays within the stored small operational range, of course, the owner is one of those individuals.

Limiting Factor→average grip force—second level of handling safety in gun personalization.

It will be installed inside the gun handle an electronic circuit, connecting a strain gage to a chip. The strain gage is placed either in the frontal part of the handle in the ergonomic position of the "greater" finger of the hand used to hold the gun, or in the posterior part of the handle in the ergonomic position of the part of hand palm correspondent to the thumb, or even in the right lateral part of the handle, for dextral shooters, or the left lateral part of the handle, for left-handed shooters, in the ergonomic position of the hand palm used to hold the gun.

Only when a grip force is within the force range stored in the chip, the trigger unlocking will occur. For instance, a secondary safety pin, always in blocking position, would be released as long as the grip force allowed its liberation.

Third Level of Sophistication

For third level of handling safety, the portable gun will be used within an even smaller group than in the second level. In practice this group is unitary and is composed by the person that grasped the handle to establish the average local grip forces, at the acquisition moment. Now, the gun handle will receive at least six strain gages integrated to an electronic circuit with a chip. Each and every strain gage will measure the local grip force at different hand positions. Each and every local grip force (Fi) is within a small local operational range ($Fai-1/2ri<Fi<Fai+1/2ri$), where Fai is an average local grip force and ri is the width of the normal distribution. For that, the gun handle will be molded to the owner hand in order to captivate local grip forces of muscular groups in the hand palm and in different fingers, with the exception of the finger that will push the trigger. In reality the gun will recognize his owner because at the moment of acquisition he will hold the handle as many times as it is necessary to compute and store his average local grip forces and the width of his normal distributions using an electronic circuit, connecting six strain gages to a chip, installed inside the gun handle. After that, the gun will only recognize for a successful firing an individual whose different local grip forces fit into the different stored small local operational ranges. Of course, the owner is one of those individuals. In consequence, there is only a very minor possibility that a different individual would satisfy the six conditions simultaneously.

Limiting Factor→average grip forces and palmar impression—third level of handling safety in gun personalization.

It is installed inside the gun handle an electronic circuit, connecting six strain gages to a chip. The strain gages are placed either in the frontal part of the handle in the ergonomic position of the three fingers of the hand used to hold the gun, in the posterior part of the handle in the ergonomic position of the part of hand palm correspondent to the thumb, and even in the right lateral part of the handle and in the left lateral part of the handle in the ergonomic position of the hand palm used to hold the gun. In this way, the gun is safe either for dextral or left-handed shooters. A dextral shooter will have zero grip force measured at the left lateral part of the handle and vice-versa for the left-handed shooter. Consequently, only when each local grip force is within the chip stored local operational force range, the trigger unlocking will occur. For instance, a secondary trigger safety pin, always in blocking position, would be released as long as the six local grip forces allowed its liberation.

Resuming, we want to stress that the indiscriminate use of a gun is dangerous but the controlled use is important to self-defense. This invention is a first step towards the gun personalization.

DESCRIPTION OF PREFERRED EMBODIMENTS

Figure 1:
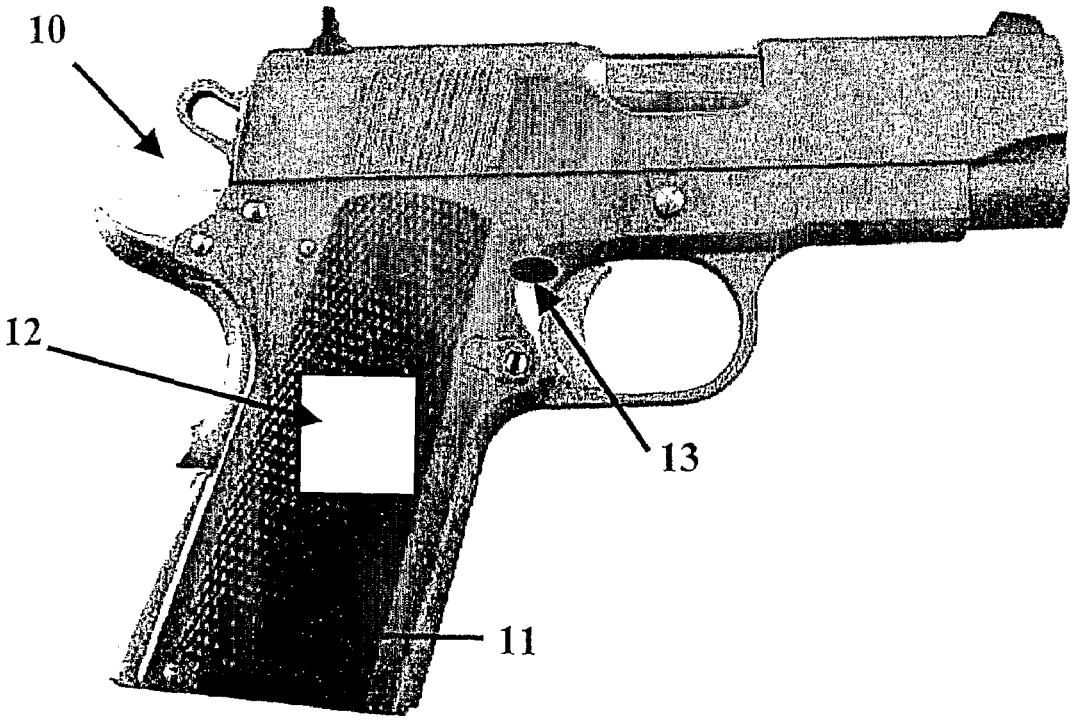
FIG. 1—Right lateral view of a gun employing the first level of handling safety, based on the resistance of the coating material of the grasping handle.

FIG. 1—The gun 10 includes the handle coating material 11, with a resistance corresponding to the inferior threshold of the grip force that only when surpassed will allow the trigger unlocking. The energy source 12 is actuated as long as the shooter grasps the handle with a grip force that surpasses the minimal resistance. The trigger safety pin 13 will always be in blocking position and will be moved to the unblocking position through the activation of the source energy, as long as the grip force surpasses the threshold.

Figure 2:
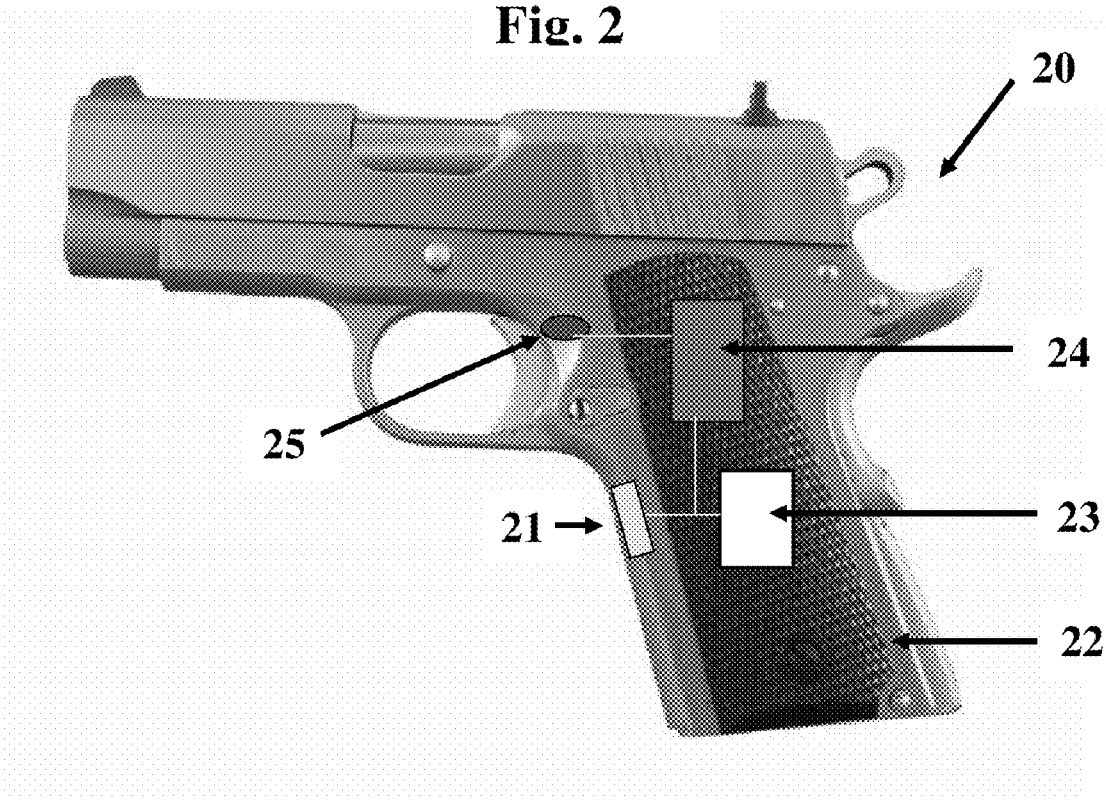
FIG. 2—Left lateral view of a gun employing the first level of handling safety, based on the measurement of the grip force using a strain gage, located in the frontal part of the handle in the ergonomic position of the "greater" finger of the hand used to hold the gun. The grip force has to be superior to an established threshold.

FIG. 2—The gun 20 includes a strain gage 21 placed in the frontal part of the handle 22 in the ergonomic position of the "greater" finger of the shooter's hand used to hold the gun. The strain gage will be used to compare the applied grip force to the inferior threshold, as a limiting factor for the employment of the gun. The energy source 23 is actuated as long as the shooter grasps the handle. An electronic circuit with chip 24 will be activated by the source energy, evaluating the applied grip force and sending the unblocking order of the trigger safety pin 25, if the force is larger than the registered threshold. The trigger safety pin will always be in blocking position and will be moved to the unblocking position through the source energy, as long as the grip force surpasses the threshold.

Figure 3:
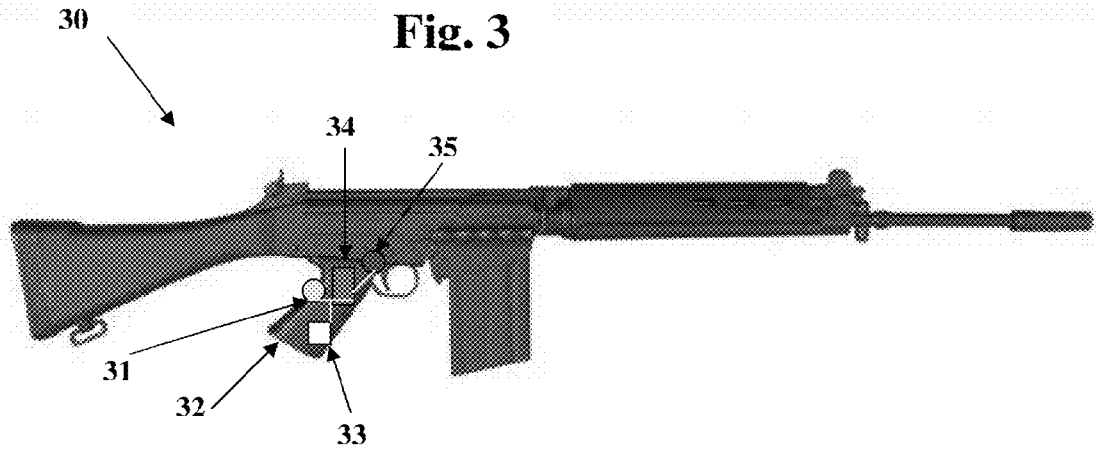
FIG. 3—Right lateral view of a gun employing the first level of handling safety, based on the measurement of the grip force using a strain gage, located in the posterior part of the handle in the ergonomic position of the part of hand palm correspondent to the thumb of the hand used to hold the gun. The grip force has to be superior to an established threshold.

FIG. 3—The gun 30 includes a strain gage 31 placed in the posterior part of the handle 32 in the ergonomic position of the part of hand palm correspondent to the thumb of the hand used to hold the gun. The strain gage will be used to compare the applied grip force to the inferior threshold, as a limiting factor for the employment of the gun. The energy source 33 is actuated as long as the shooter grasps the handle. An electronic circuit with chip 34 will be activated by the source energy, evaluating the applied grip force and sending the unblocking order of the trigger safety pin 35, if the force is larger than the registered threshold. The trigger safety pin will always be in blocking position and will be moved to the unblocking position, through the source energy, as long as the grip force surpasses the threshold.

Figure 4:
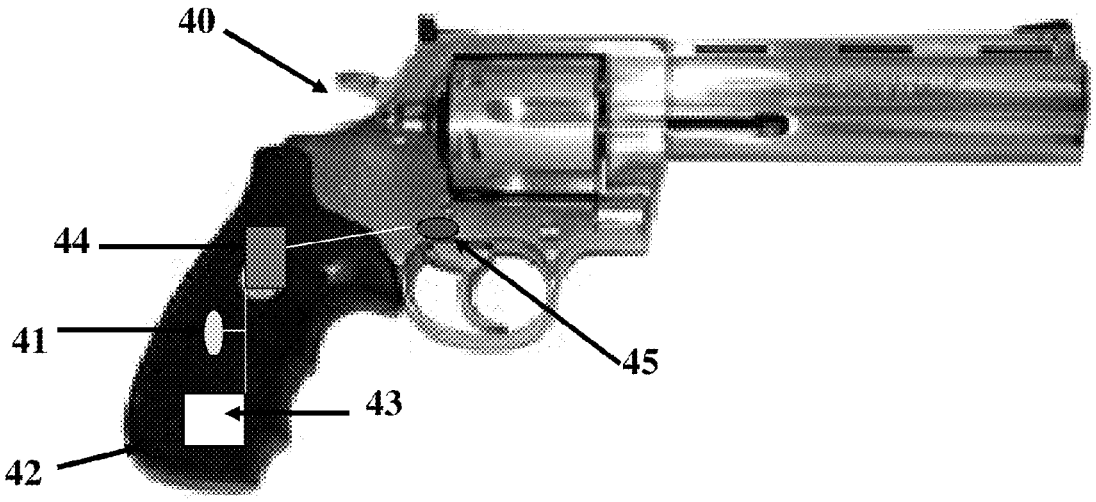
FIG. 4—Right lateral view of a gun employing the first level of handling safety, based on the measurement of the grip force using a strain gage, located in the right lateral part of the handle, for dextral shooters, in the ergonomic position of the hand palm used to hold the gun. The grip force has to be superior to an established threshold.

FIG. 4—The gun 40 includes a strain gage 41 placed in the right lateral part of the handle 42, for dextral shooters, in the ergonomic position of the hand palm used to hold the gun. The strain gage will be used to compare the applied grip force to the inferior threshold, as a limiting factor for the employment of the gun. The energy source 43 is actuated as long as the shooter grasps the handle. An electronic circuit with chip 44 will be activated by the source energy, evaluating the applied grip force and sending the unblocking order of the trigger safety pin 45, if the force is larger than the registered threshold. The trigger safety pin will always be in blocking position and will be moved to the unblocking position, through the source energy, as long as the grip force surpasses the threshold.

Figure 5:
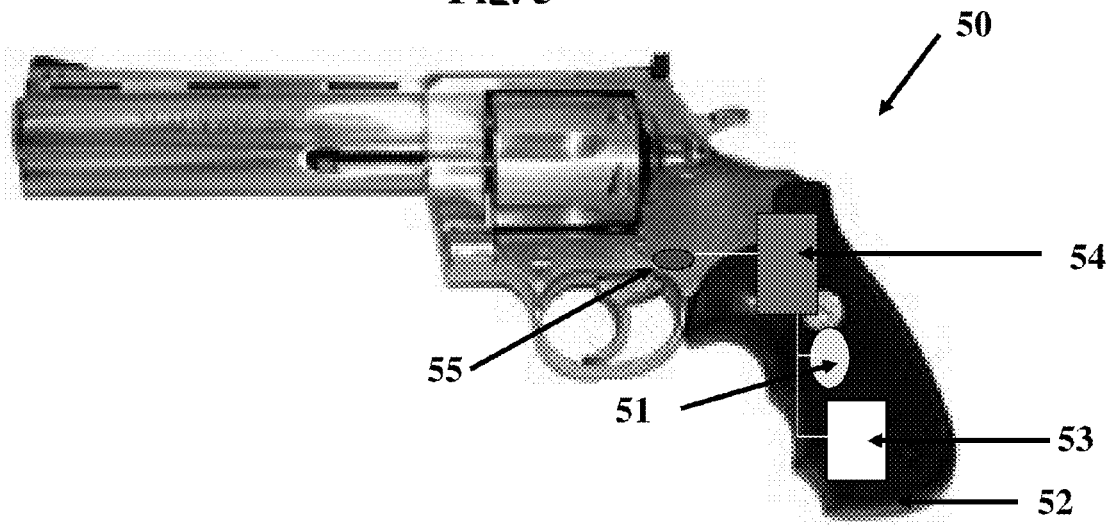
FIG. 5—Left lateral view of a gun employing the first level of handling safety, based on the measurement of the grip force using a strain gage, located in the left lateral part of the handle, for left-handed shooters, in the ergonomic position of the hand palm used to hold the gun. The grip force has to be superior to an established threshold.

FIG. 5—The gun 50 includes a strain gage 51 placed in the left lateral part of the handle 52, for left-handed shooters, in the ergonomic position of the hand palm used to hold the gun. The strain gage will be used to compare the applied grip force to the inferior threshold, as a limiting factor for the employment of the gun. The energy source 53 is actuated as long as the shooter grasps the handle. An electronic circuit with chip 54 will be activated by the source energy, evaluating the applied grip force and sending the unblocking order of the trigger safety pin 55, if the force is larger than the registered threshold. The trigger safety pin will always be in blocking position and will be moved to the unblocking position, through the source energy, as long as the grip force surpasses the threshold.

Figure 6:
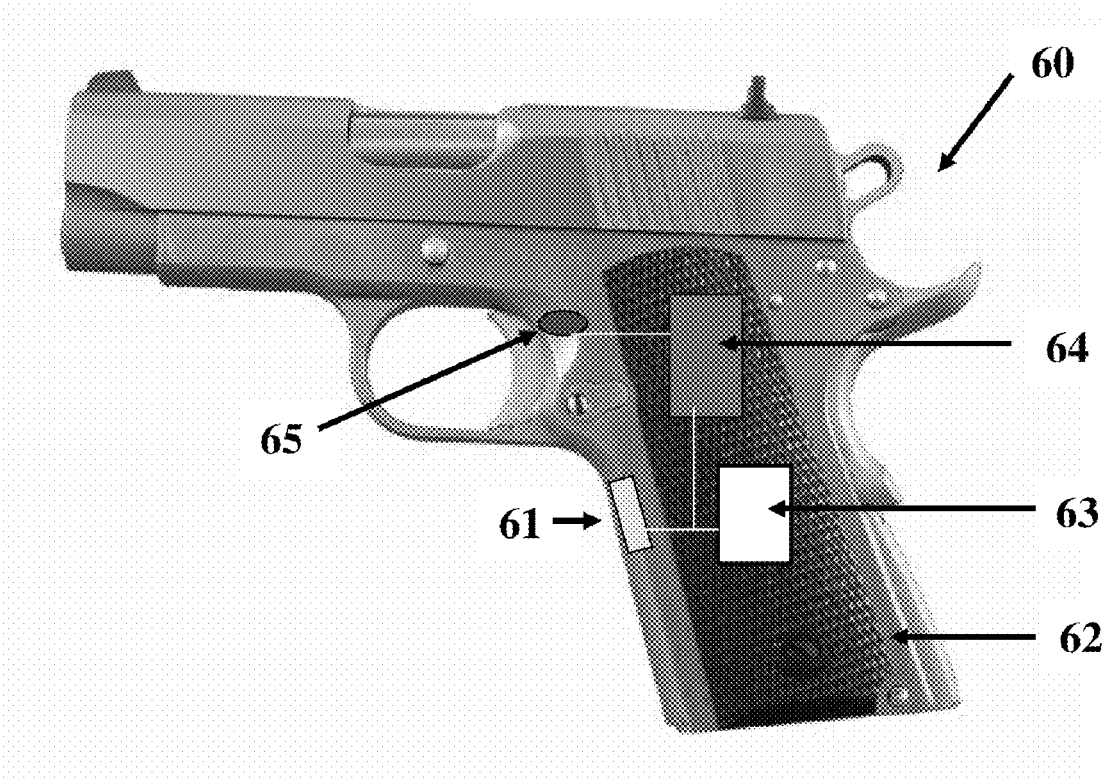
FIG. 6—Left lateral view of a gun employing the second level of handling safety, based on the measurement of the grip force using a strain gage, located in the frontal part of the handle in the ergonomic position of the "greater" finger of the hand used to hold the gun. The grip force has to fit into the small operational range, established and stored at the moment of acquisition by the gun owner.

FIG. 6—The gun 60 includes a strain gage 61 placed in the frontal part of the handle 62 in the ergonomic position of the "greater" finger of the shooter's hand used to hold the gun. The strain gage will be used to verify if the applied grip force fit into the small operational range, established at acquisition by the owner. The energy source 63 is actuated as long as the shooter grasps the handle. An electronic circuit with chip 64 will be activated by the source energy, evaluating the applied grip force and sending the unblocking order of the trigger safety pin 65, if the force fit into the small operational range. The trigger safety pin will always be in blocking position and will be moved to the unblocking position, through the source energy, as long as the grip force fit into the small operational range.

Figure 7:
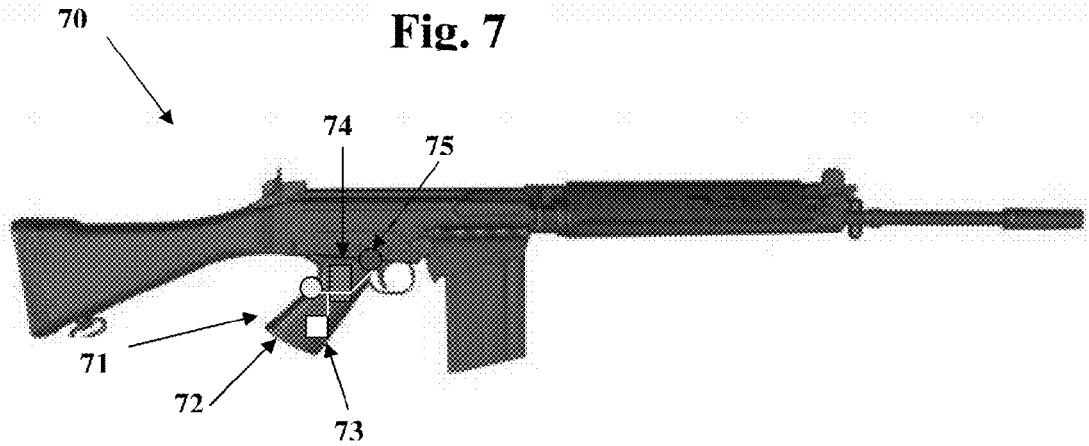
FIG. 7—Right lateral view of a gun employing the second level of handling safety, based on the measurement of the grip force using a strain gage, located in the posterior part of the handle in the ergonomic position of the part of hand palm correspondent to the thumb of the hand used to hold the gun. The grip force has to fit into the small operational range, established and stored at the moment of acquisition by the gun owner.

FIG. 7—The gun 70 includes a strain gage 71 placed in the posterior part of the handle 72 in the ergonomic position of the part of hand palm correspondent to the thumb of the hand used to hold the gun. The strain gage will be used to verify if the applied grip force fit into the small operational range, established at acquisition by the owner. The energy source 73 is actuated as long as the shooter grasps the handle. An electronic circuit with chip 74 will be activated by the source energy, evaluating the applied grip force and sending the unblocking order of the trigger safety pin 75, if the force fit into the small operational range. The trigger safety pin will always be in blocking position and will be moved to the unblocking position, through the source energy, as long as the grip force fit into the small operational range.

Figure 8:
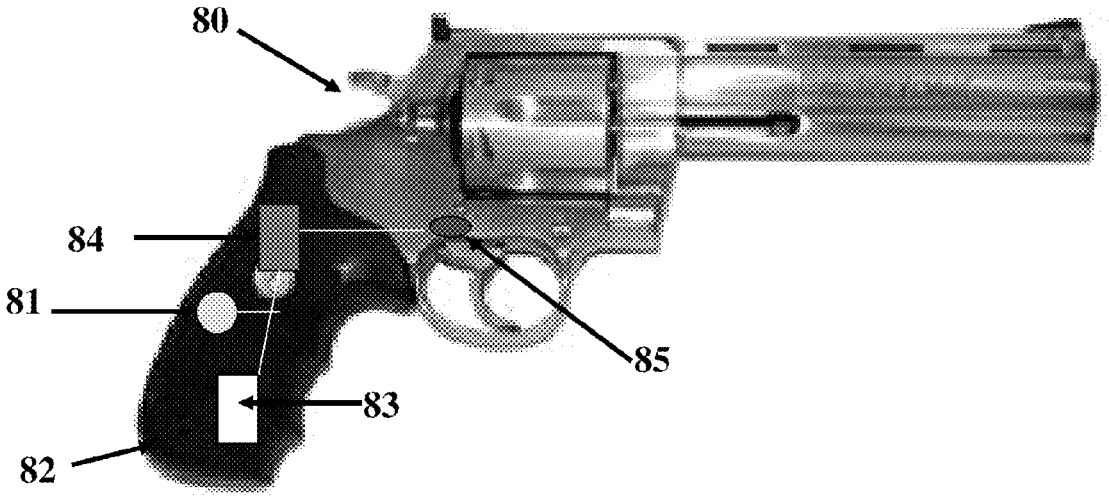
FIG. 8—Right lateral view of a gun employing the second level of handling safety, based on the measurement of the grip force using a strain gage, located in the right lateral part of the handle, for dextral shooters, in the ergonomic position of the hand palm used to hold the gun. The grip force has to fit into the small operational range, established and stored at the moment of acquisition by the gun owner.

FIG. 8—The gun 80 includes a strain gage 81 placed in the right lateral part of the handle 82, for dextral shooters, in the ergonomic position of the hand palm used to hold the gun. The strain gage will be used to verify if the applied grip force fit into the small operational range, established at acquisition by the owner. The energy source 83 is actuated as long as the shooter grasps the handle. An electronic circuit with chip 84 will be activated by the source energy, evaluating the applied grip force and sending the unblocking order of the trigger safety pin 85, if the force fit into the small operational range. The trigger safety pin will always be in blocking position and will be moved to the unblocking position, through the source energy, as long as the grip force fit into the small operational range.

Figure 9:
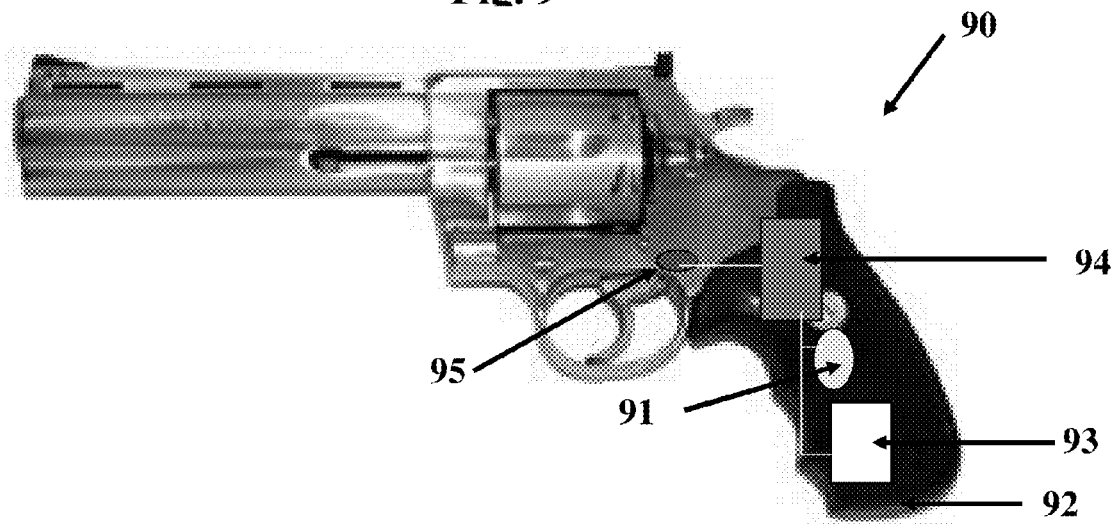
FIG. 9—Left lateral view of a gun employing the second level of handling safety, based on the measurement of the grip force using a strain gage, located in the left lateral part of the handle, for left-handed shooters, in the ergonomic position of the hand palm used to hold the gun. The grip force has to fit into the small operational range, established and stored at the moment of acquisition by the gun owner.

FIG. 9—The gun 90 includes a strain gage 91 placed in the left lateral part of the handle 92, for left-handed shooters, in the ergonomic position of the hand palm used to hold the gun. The strain gage will be used to verify if the applied grip force fit into the small operational range, established at acquisition by the owner. The energy source 93 is actuated as long as the shooter grasps the handle. An electronic circuit with chip 94 will be activated by the source energy, evaluating the applied grip force and sending the unblocking order of the trigger safety pin 95, if the force fit into the small operational range. The trigger safety pin will always be in blocking position and will be moved to the unblocking position, through the source energy, as long as the grip force fit into the small operational range.

Figure 10:
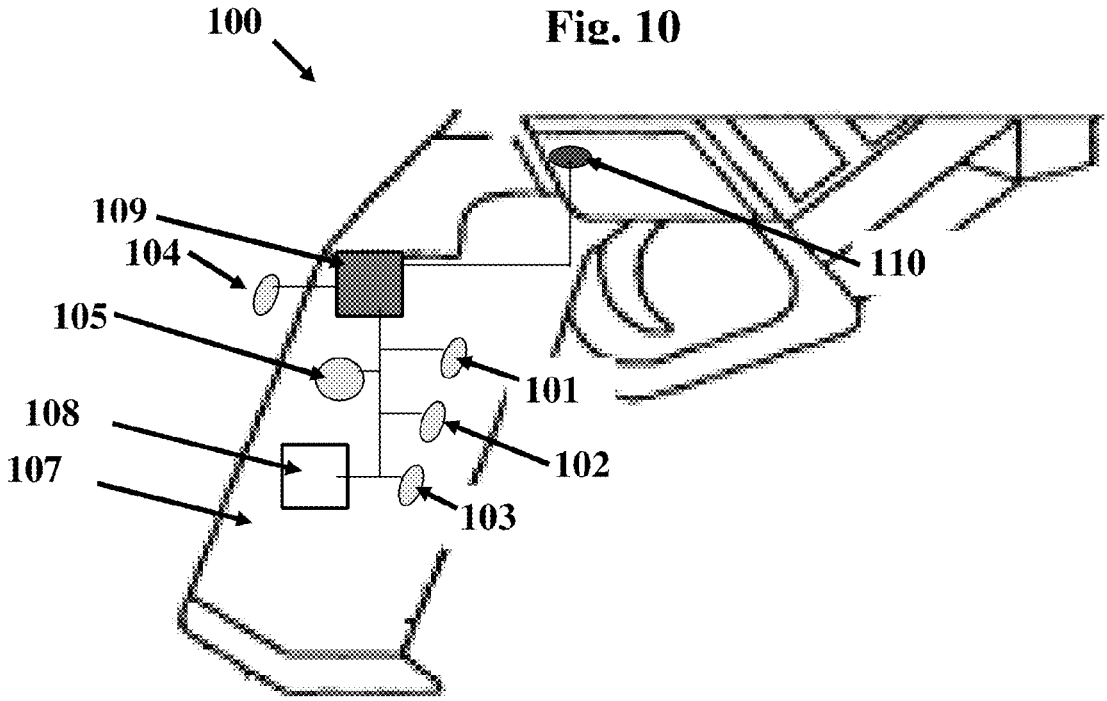
FIG. 10—A right lateral view of a gun employing the third level of handling safety, based on the measurement of local grip forces using up to six strain gages, located in the frontal part of the handle in the ergonomic position of the three fingers of the hand used to hold the gun, in the posterior part of the handle in the ergonomic position of the part of hand palm correspondent to the thumb, and even in the right lateral part of the handle and also in the left lateral part of the handle, in the ergonomic position of the hand palm used to hold the gun. The six local grip forces have to fit into the six small local operational ranges, established and stored at the moment of acquisition by the gun owner.

FIG. 10—The gun 100 includes six strain gages (101, 102, 103, 104, 105 and 106—not showed, since it is in the left lateral part of the handle) placed in the frontal part of the handle 107 in the ergonomic position of the three fingers of the hand used to hold the gun (strain gages 101, 102 and 103), in the posterior part of the handle in the ergonomic position of the part of hand palm correspondent to the thumb (strain gage 104), and even in the right lateral part of the handle (strain gage 105) and also in the left lateral part of the handle (strain gage 106—not showed symmetric to 105), in the ergonomic position of the hand palm used to hold the gun. The six strain gages will be used to verify if the locally applied grip forces fit into the six small operational ranges, established at acquisition by the owner. The energy source 108 is actuated as long as the shooter grasps the handle. An electronic circuit with chip 109 will be activated by the source energy, evaluating the locally applied grip forces and sending the unblocking order of the trigger safety pin 110, if the six forces fit into every one of the six small operational ranges. The trigger safety pin will always be in blocking position and will be moved to the unblocking position, through the source energy, as long as the six grip forces fit into the six small operational ranges.

The invention claimed is:

1. A portable gun, comprising:

a body having a barrel;

a handle having a pressure activated energy source and a trigger mechanism with a trigger safety pin, the handle is connected to the body opposite the barrel;

means for establishing a first level of owner recognition by determining when an applied grip force is greater than an established threshold; and wherein the trigger safety pin of the trigger mechanism is released by the means for establishing the first level of owner recognition, wherein the established threshold comprises a minimum grip force and wherein the applied grip force is measured by said means for establishing the first level of owner recognition, said means for establishing the first level of owner recognition comprises a strain gauge and a chip connected by an electronic circuit, wherein the strain gauge, the chip and electronic circuit are installed inside the handle or the body or both the handle and the body.

2. A portable gun of claim 1, wherein the strain gauge is placed either in a frontal part of the handle in a first ergonomic position of a greater finger of a hand used to hold the gun, or in a posterior part of the handle in a second ergonomic position of a part of a hand palm correspondent to a thumb, or in a right lateral part of the handle, or a left lateral part of the handle, in a third ergonomic position of the hand palm used to hold the gun.

3. A portable gun, comprising:

a body having a barrel;

a handle having a pressure activated energy source and a trigger mechanism with a trigger safety pin, the handle is connected to the body opposite the barrel; and means for establishing a second level of owner recognition when an applied grip force is within a small operational range; and wherein the trigger safety pin of the trigger mechanism is released by the means for establishing the second level of owner recognition when the applied grip force is within the small operational range, the small operational range comprises an average grip force of the owner and a width of a normal distribution of the owner, wherein said means for establishing the second level of owner recognition comprises a strain gauge and a chip, the strain gauge and the chip are both connected by an electronic circuit, and the strain gauge, the chip and the electronic circuit are all installed inside the handle or the body or both the handle and the body.

4. A portable gun of claim 3, wherein the strain gauge is placed either in a frontal part of the handle in a first ergonomic position of a greater finger of a hand used to hold the gun, or in a posterior part of the handle in a second ergonomic position of the part of a hand palm correspondent to a thumb, or in a right lateral part of the handle, or a left lateral part of the handle in a third ergonomic position of the hand palm used to hold the gun.

5. A portable gun, comprising:

a body having a barrel;

a handle having a pressure activated energy source and a trigger mechanism with a trigger safety pin, the handle is connected to the body opposite the barrel; and means for establishing a third level of owner recognition based upon an operation range of the owner; and wherein the trigger safety pin of the trigger mechanism is released by the means for establishing the third level of owner recognition based upon the operational range of the owner, the operational range comprising an average local grip force by the owner and a width of a normal distribution of the owner, wherein the means for establishing a third level of owner recognition comprise a plurality of strain gauges and a chip, the gauges and the chip are connected by an electronic circuit, and the gauges, the chip and the electronic circuit are all installed inside the handle or the body or both the handle and the body.

6. A portable gun of claim 5, wherein the at least one strain gauge is placed either in a frontal part of the handle in a first ergonomic position of a three fingers of a hand used to hold the gun, or in a posterior part of the handle in a second ergonomic position of a part of a hand palm correspondent to a thumb, or in a right lateral part of the handle, or a left lateral part of the handle in a third ergonomic position of the hand palm used to hold the gun wherein a dextral shooter will measure a zero grip force at the left lateral part of the handle and a left-handed shooter will measure a zero grip force at the right lateral part of the handle.

7. A portable gun, comprising:

a body having a barrel;

a handle having a pressure activated energy source and a trigger mechanism with a trigger safety pin, the handle is connected to the body opposite the barrel; and means for determining a level of owner recognition to actuate the pressure activated energy source and release the trigger safety pin, the means for determining electronically connected to chip, wherein the means for determining the level of owner recognition and the chip are both installed within the handle or within the body or within both the handle and the body.

8. The portable gun of claim 7, wherein the means for determining a level of owner recognition comprises means for determining a first level of owner recognition.

9. The portable gun of claim 8, wherein the means for determining the first level of owner recognition comprises means for determining a first applied grip force.

10. The portable gun of claim 9, wherein the first applied grip force comprises a grip force exerted by a hand upon the handle that exceeds an established threshold grip force.

11. The portable gun of claim 9, wherein the means for determining the first applied grip force and the chip are electronically connected by an electronic circuit.

12. The portable gun of claim 9, wherein the means for determining the first applied grip force comprises a strain gauge.

13. The portable gun of claim 8, wherein the means for determining the first level of owner recognition is installed in a frontal part of the handle at a first ergonomic position defined by the placement of a greater finger of a hand, or a posterior part of the handle at a second ergonomic position defined by the placement of a thumb of the hand, or a left lateral part of the handle at a third ergonomic position defined by the placement of a palm of the hand, or a right lateral part of the handle.

14. The portable gun of claim 7, wherein the means for determining a level of owner recognition further comprises means for determining a second level of owner recognition.

15. The portable gun of claim 14, wherein the means for determining the second level of owner recognition comprises a means for determining a second applied grip force.

16. The portable gun of claim 15, wherein the second applied grip force comprises an average grip force exerted by a hand upon the handle and a width of normal distribution applied by the hand upon the handle.

17. The portable gun of claim 15, wherein the means for determining the second applied grip force comprises a strain gauge.

18. The portable gun of claim 15, wherein the means for determining the second level of owner recognition is installed in a frontal part of the handle at a first ergonomic position defined by the placement of a greater finger of a hand, or a posterior part of the handle at a second ergonomic position defined by the placement of a thumb of the hand, or a left lateral part of the handle at a third ergonomic position defined by the placement of a palm of the hand, or a right lateral part of the handle.

19. The portable gun of claim 7, wherein the means for determining a level of owner recognition further comprises means for determining a third level of owner recognition.

20. The portable gun of claim 19, wherein the means for determining the third level of owner recognition comprises at least six strain gauges.

21. The portable gun of claim 19, wherein the means for determining the third level of owner recognition comprises a means for determining a third applied grip force.

22. The portable gun of claim 21, wherein the third applied grip force comprises an average local grip force exerted by a hand upon the handle and a width of normal distribution applied by the hand upon the handle.

23. The portable gun of claim 19, wherein the means for determining the third level of owner recognition is installed in a frontal part of the handle at a first ergonomic position defined by the placement of three fingers of a hand, or a posterior part of the handle at a second ergonomic position defined by the placement of a thumb of the hand, or a left lateral part of the handle at a third ergonomic position defined by the placement of a palm of the hand, or a right lateral part of the handle.

24. The portable gun according to any of claims 1, 3, 5 and 7, wherein the energy source is actuated by a gripping force applied to the handle, and wherein the electronic circuit is activated by energy from the energy source to establish owner recognition.

* * * * *